United States Patent [19]

Duescher

[11] 4,261,272

[45] Apr. 14, 1981

[54] APPARATUS FOR PRODUCING SEWN SEAMS

[75] Inventor: Wayne O. Duescher, St. Paul, Minn.

[73] Assignee: FisHair Incorporated, St. Paul, Minn.

[21] Appl. No.: 35,408

[22] Filed: May 2, 1979

[51] Int. Cl.[3] ..... D05B 27/00

[52] U.S. Cl. ..... 112/217; 118/32; 118/410; 156/467; 156/578; 112/262.1

[58] Field of Search ..... 112/217, 142, 141; 156/93, 467, 578; 118/32, 410

[56] References Cited

U.S. PATENT DOCUMENTS

| | | | |
|---|---|---|---|
| 1,691,493 | 11/1928 | Osgood | 156/467 X |
| 2,055,470 | 9/1936 | Anderson et al. | 112/217 |
| 3,068,137 | 12/1962 | Seubert | 156/467 X |
| 3,720,559 | 3/1973 | Odom et al. | 156/467 X |

FOREIGN PATENT DOCUMENTS

| | | | |
|---|---|---|---|
| 531902 | 10/1976 | U.S.S.R. | 112/217 |

*Primary Examiner*—H. Hampton Hunter
*Attorney, Agent, or Firm*—Hill, Van Santen, Steadman, Chiara & Simpson

[57] ABSTRACT

A method and apparatus for use with a sewing machine by which a liquid is injected between lapped layers of material being sewn. A supply of the liquid at atmospheric pressure is fed by gravity to a constant displacement pump, the pump being actuated by a driven part of the sewing machine so that pumping rate is proportional to sewing rate. The outlet of the pump passes through a line which divides under the control of valve means. One branch of the line leads to a tube that is disposed in a folder, the tube having a discharge end projecting from the folder and disposed just upstream of the sewing machine needle(s). A further flattening roller is disposed after the presser foot through which the needles reciprocate. The other branch of the line is a return line that leads back to the reservoir. Thus pressurized metered liquid such as sealant is injected between the layers of material and the liquid is hydrostatically pressurized by the pressure foot so that when the needle passes therethrough, the liquid is forced into the space in each needle hole surrounding the thread. A subsequent flattening or repressurizing step is provided for the seam after it has left the pressure foot. The flow of liquid is interrupted just before the end of the seam is reached, such as two inches, to prevent the discharge of an excessive amount of liquid.

8 Claims, 7 Drawing Figures

FIG. 1
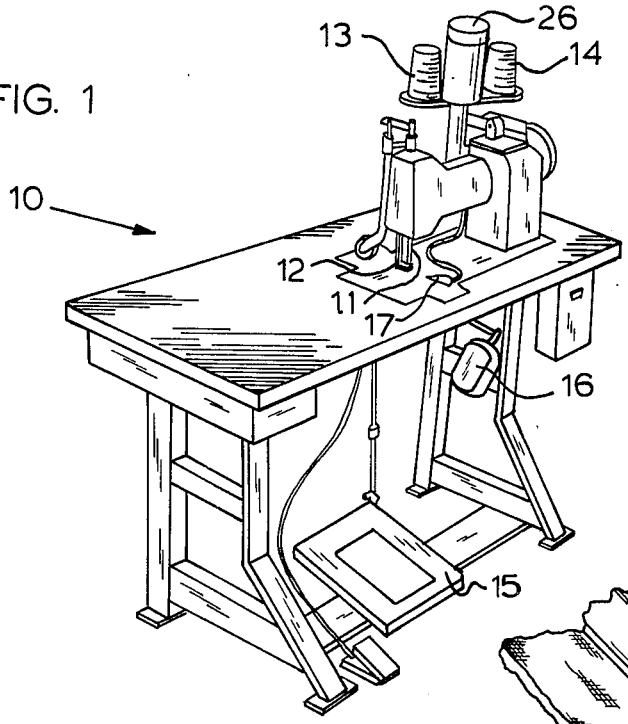
FIG. 2
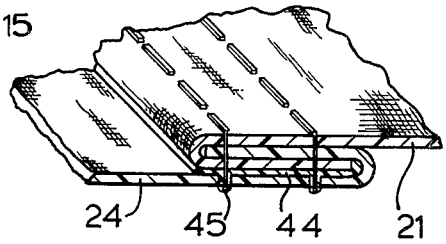
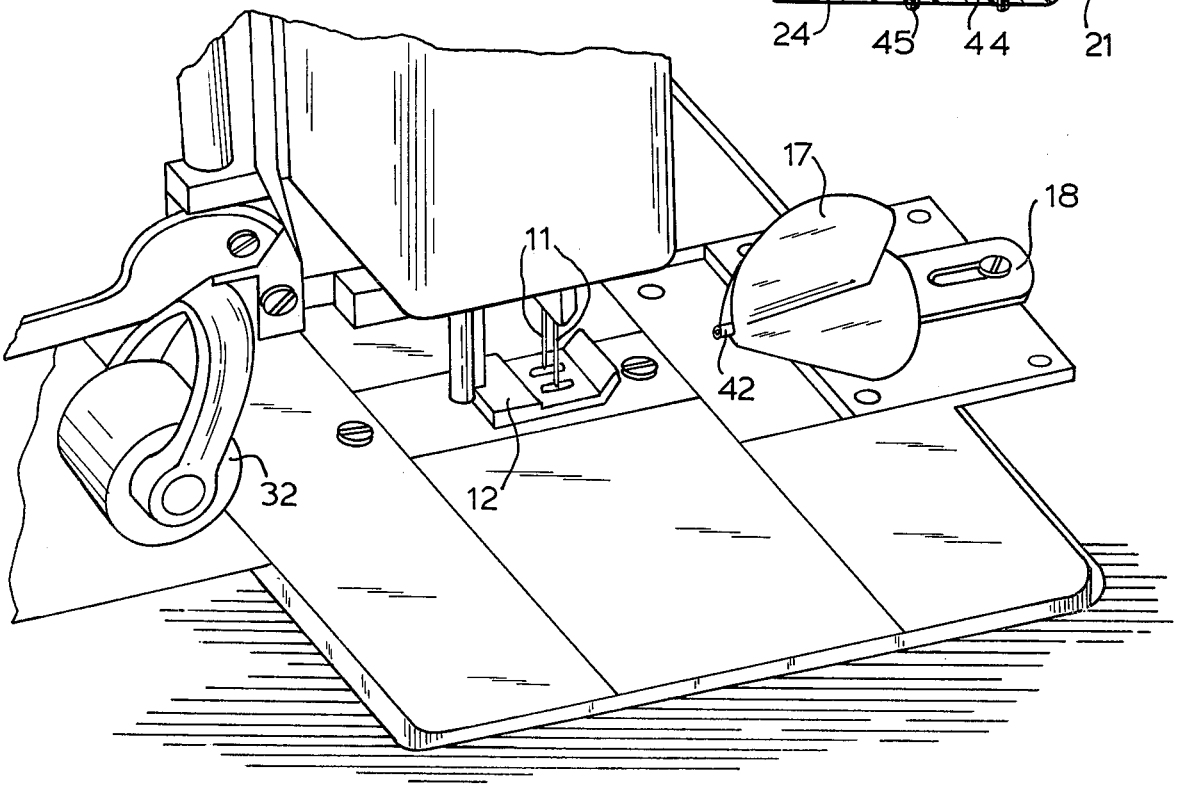
FIG. 3

APPARATUS FOR PRODUCING SEWN SEAMS

BACKGROUND OF THE INVENTION

1. Field of the Invention

This invention relates to a method and apparatus for sewing, and more specifically to a method and apparatus by which a liquid is injected into the seam during sewing.

2. Prior Art

There presently is a need to seal the needle puncture holes in fabric, sheet plastic, and other materials after the material is sewn, by single, double or triple needle sewing machines. This sealing effect is particularly necessary on tent materials to prevent moisture penetration through the full-depth needle hole or through the needle hole in the top layer of material and then into the seam or seams between the two layers of material. A thread hole sealing process can also be used to act as a barrier for bacteria in sewn items such as hospital gowns, operating room gowns, and the like. Among the methods that have been tried to prevent leakage through the sewing needle holes are attempts such as spraying on exterior flexible air-drying sealing agents and applying the sealing fluid between seam layers before they are assembled for sewing. Also, attempts have been made to use sealing tapes before the material is sewn. None of the known methods have satisfactorily sealed the sewn area, and furthermore they have generated cosmetic or physical bad side effects such as puckering in a sewn joint, or else there has been an excessive amount of sealing material on the outside surfaces of the sewn material.

SUMMARY OF THE INVENTION

Accordingly, it is an object of the present invention to provide a method and apparatus by which a liquid may be applied to a seam without there being an excessive exterior amount of such liquid, while achieving full penetration of the needle holes.

According to the invention, apparatus is applied to a known type of sewing machine for making improved lap seams by using a constant displacement pump to force a suitable liquid through the discharge end of a tube into the lapped material as it is about to be engaged by the presser foot and needle of the sewing machine, whereby the presser foot hydrostatically pressurizes the liquid under it and through which the needle passes. The flow of liquid into the lapped material is interrupted just before the end of the seam is reached, by means of a foot-operated control, and if desired, a pressure roller flattens the finished seam just as it emerges from the presser foot before the liquid has had time to dry. In a preferred embodiment, the liquid is used as a sealant and is a viscous suspension of latex in a water base.

Accordingly, it is a further object of the present invention to provide such apparatus for modifying a sewing machine without the use of any external power supply.

A still further object of the present invention is to modify a sewing machine for the purpose stated but in such a way that modifying apparatus does not interfere with the normal usage of the sewing machine.

Another object of the present invention is to provide a method and apparatus that will produce a seam which is compatible with various fabrics or other materials as well as compatible with their uses, such as adequate strength and stretchability.

Yet another object of the invention is to provide a method for producing such a seam which will not be toxic, which will give off no fumes, and wherein the liquid used will, when needed, also function as a lubricant, hence eliminating any need for needle cooling means as might be the case with sewing in vinyl fabric.

A still further object of the present invention is to provide a method wherein the liquid will not adhere to the sewing machine, that will be slow to wet the thread, that won't leak into the machine, and that won't spread out much at the area of the material where the seam is located.

Yet another object of the present invention is to provide a method and apparatus which, in addition to sealing, or in place thereof may enable the use of other liquids or additives to effect marking, mold and mildew prevention, a chemical reaction, dyeing, matching or contrasting coloring, insecticide function, and the use of heat or light activated liquids.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

ON THE DRAWINGS

FIG. 1 is a perspective view of a conventional sewing machine modified to include apparatus in accordance with the present invention to carry out a method in accordance with the present invention;

FIG. 2 is a fragmentary enlarged cross-sectional view of a representative type of seam that can be made using the present invention;

FIG 3 is an enlarged fragmentary view shown in perspective from the rear of a portion of FIG. 1;

AS SHOWN ON THE DRAWINGS

Figure 7:
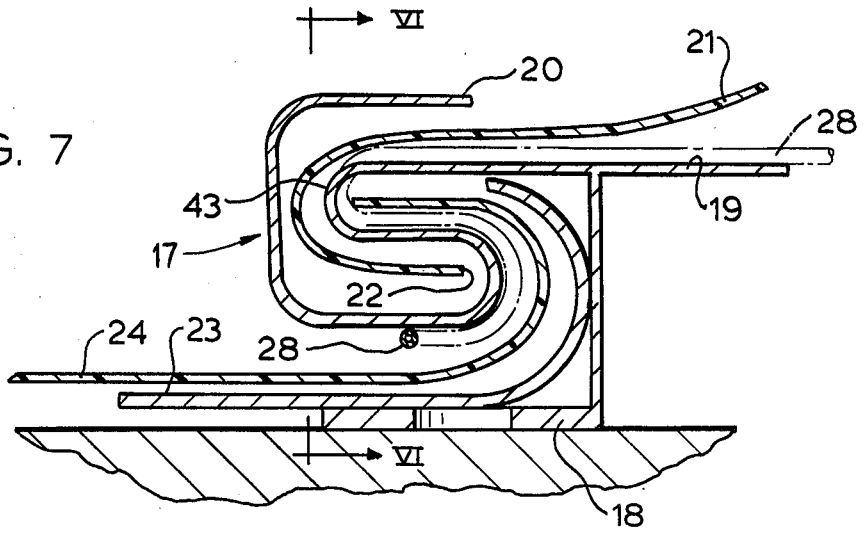
FIG. 7 is an enlarged cross-sectional view taken generally along the line VII—VII of FIG. 6.

The apparatus for producing sewn seams in lapped layers of material is shown in FIG. 1 as including a modified conventional sewing machine, generally indicated by the numeral 10. The machine 10 may have 1, 2 or more needles 11, a 2-needle machine being illustrated. The needles are reciprocated through openings in a presser foot 12, best shown in FIG. 3. A bobbin 13 provides thread to one needle and a bobbin 14 provides thread to the other needle. The sewing machine 10 has a conventional foot-operated speed control or pedal 15 and a conventional knee-operated device 16 for raising and lowering the presser foot 12. Although the layers of material to be sewn together may be lapped in several ways, or by hand, one way of arranging the materials is to feed their edges simultaneously through a folder 17. The folder 17 is a modified conventional folder which has a base 18 which may be adjustably secured to the top of the sewing machine as shown in FIG. 3. The base 18 extends upwardly along one edge as shown in FIG.

Figure 6:
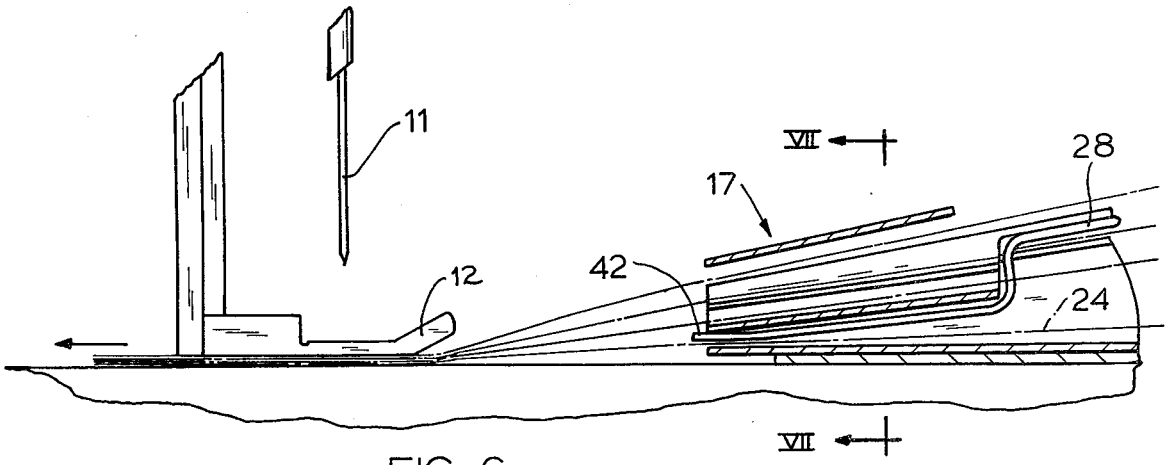
FIG. 6 is an enlarged fragmentary portion, partly in cross section, of a portion of FIG. 4, taken generally along the line VI—VI of FIG. 7.

7 to provide a support surface 19 which, in this view, extends to the left and follows a generally S-shaped configuration merging into a generally C-shaped configuration that terminates along an edge 20. One layer of material 21 can be pushed in laterally until its leading edge 22 is disposed within the lower curve of the S-shape. A further support surface 23 extends from the left to the right in generally concentric relation with the lower curve of the S-shape to enable it to guide a second sheet of material 24 around the outside of the lower curve of the S-shape and into the upper curve of the S-shape. The operator can than feed the material to the presser foot 12 which, in FIG. 7, is in a direction away from the viewer. The guide surfaces converge as shown in FIG. 6 to enable such guidance.

Figure 4:
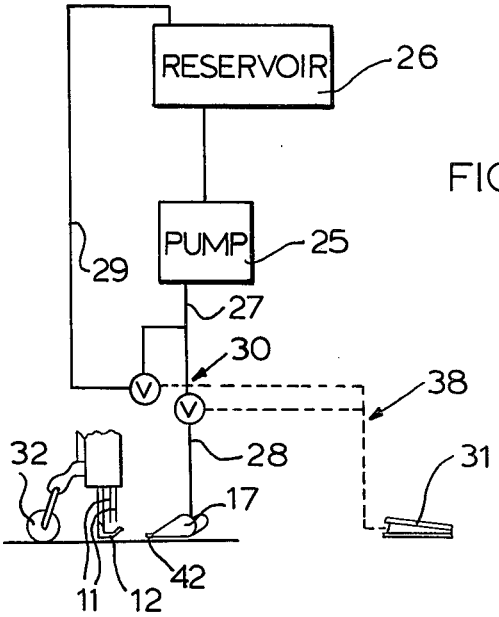
FIG. 4 is a schematic diagram of the apparatus.

As shown in FIG. 4, the apparatus includes a pump 25 of the constant displacement or metering type to which liquid is fed from a reservoir 26, the outlet of the pump 25 leading to a fluid line 27 to which there is connected a tube 28. A return line 29 is connected to the fluid line 27 for conducting liquid back to the inlet of the pump 25 through the reservoir 26. Valve means generally indicated by the numeral 30 comprise a foot-operated valve which includes a foot-operated pedal control 31. If desired, a pressure roller 32 is secured to the sewing machine and is disposed to roll on and flatten the newly-formed seam as it emerges from beneath the rear side of the presser foot 12.

Figure 5:
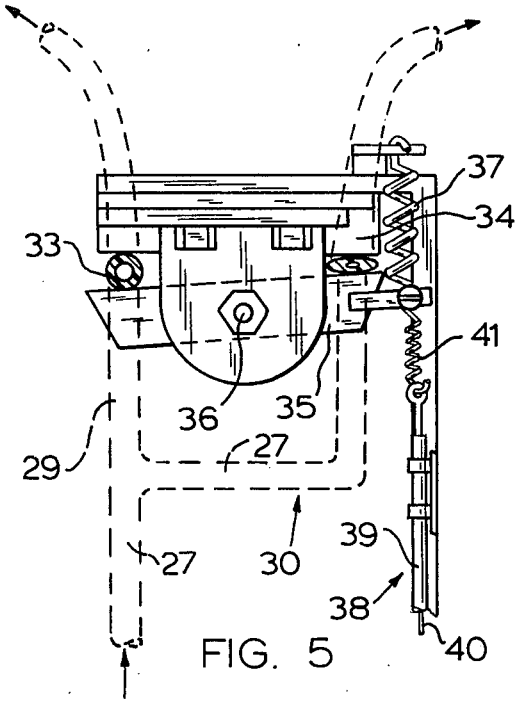
FIG. 5 is a schematic view, partly in cross section, showing valve means illustrated in FIG. 4.

The valve means 30 are illustrated in FIG. 5. The liquid from the pump 25 is brought through the fluid line 27, and at a connection between the return line 29 and the fluid line 27, the liquid can flow in one or another path. To that end, the return line 29 has a first collapsible portion 33 and the fluid line 27 has a second collapsible portion 34 disposed downstream from the connection with the return line 29. A lever 35 is pivoted at 36, there being a bias spring 37 which normally urges one end of the lever 35 upwardly so as to compress and close the second collapsible portion 34, thus leaving the return line 29 open at the first collapsible portion 33. The foot-operated control 31 includes a Bowden wire assembly 38 which has a fixed sheath 39 and a movable wire 40 connected through an overtravel spring 41 to the pivoted lever 35. The spring 41 is sufficiently stiff to transmit a force to the wire 40 emanating from the bias spring 37, and yet it will yield in response to excess downward travel of the wire 40 after the first collapsible portion 33 has been closed.

The constant delivery or metering pump 25 is mounted on the sewing machine head just beneath the reservoir 26 as shown in FIG. 1. With this arrangement, the reservoir 26 is not pressurized and can conduct liquid by gravity to the inlet of the pump 25. The pump 25 is actuated by a driven part of the sewing machine 10. One structure for driving the pump is to utilize a cam on the upper sewing machine drive shaft for directly activating the pump. Other sources of power take-off from the sewing machine may be employed. For example, a drive wheel could be used to frictionally engage the internal main drive belt at the upper section of the sewing machine. Also, the pump may be driven by the external V-belt machine drive. The pump could include an integral cam activator or could be directly driven. If desired, a gear or other speed reducer can be used to slow down the pump reciprocating speed without affecting its metering ability. The details of a particularly advantageous pump for this purpose are disclosed and claimed in my application for U.S. patent on a "Pump", filed Apr. 12, 1979, Ser. No. 029,395 which is incorporated herein by reference. With such an arrangement, the volumetric pumping rate will be proportional to the speed at which the sewing machine is being operated, or in otherwords, will be in proportion to the sewing rate.

The tube 28 receives liquid from the fluid line 27 and is supported by the sewing machine. The tube 28 is curved to accommodate any particular type of lap seam that is to be sewn, and to accommodate any particular folder 17 that may be used. As shown in FIG. 6, the tube 28 enters the folder 17 and then is curved about so as not to interfere with any of the movements of the fabric or other material therein, the tube 28 terminating at a discharge end 42 which is adjacent to the presser foot 12 and which projects from the folder 17. FIG. 7 shows the curvature of the tube 28 from a different perspective, illustrating that it lies beneath the upper sheet of material 21, beginning from a point located quite a distance away from the curving guide surfaces so as not to be located in a position to interfere with the operator's work. The tube 28 then follows through an opening at 43 in the S-shaped guide wall, and then it passes between the lower guide surface 23 and the lower end of the S-shape against which it engages and is secured. Such a disposition places the tube 28 in that region above the other sheet 24.

As soon as the sewing machine 10 is started, the pump 25 also starts and as soon as the operator wants liquid to be present in the seam, the operator actuates the foot-operated control 31 to open the line 27 to the tube 28 where liquid discharges from the discharge end 42, just as the lapped portions of the material are about to enter beneath the presser foot 12 to be sewn by the needles 10. In this embodiment, with two needles the discharge end 42 is disposed midway between the prospective lines of sewing. If there were three needles, a further liquid discharge end 42 would be provided between the other adjacent pair of prospective seams. While the sewing is going on, the material continues to pass freely both over and below the tube 28.

With viscous liquid present between the layers, the force from the presser foot 12 creates a hydrostatic pressure in the area being sewn, and each needle 11 pierces the thin layer of pressurized sealant, shown in enlarged form at 44 in FIG. 2, whereupon liquid is hydrostatically forced in to fill the needle hole around the thread as shown at 45. Where the material constitutes waterproof fabric or other material such as nylon, urethane-coated nylon, vinyl fabric or the like, the liquid should be a sealant, for example, a viscous latex suspension carried in a water base, the viscosity being approximately that of a soft ice cream or syrup. Because of the speed at which the seam is made, there is little opportunity for the viscous liquid to wet the thread but the subsequent roller 32 appears to force the liquid into the thread and into the portions of the thread that bridge the needle holes. The roller 32 also flattens the seam and fills any voids that exist in the space occupied by the sealant shown at 44 in FIG. 2. Thus, where the sealant is an adhesive, the layers of material are also adhesively bonded along the lapped stitched seam.

In one test, nylon fabric was sewn as shown in FIG. 2 but omitting the sealant 44. The stitched seam leaked at various points along its length beginning just above zero psi and going up to 5 psi. With the seam made as shown in FIG. 2, and as described, the pressure leakage rating had a consistent value between 15 and 25 psi, the material itself having a fabric burst test rating of about 50 psi. Larger needle holes are filled with a greater quantity of sealant automatically as the flow resistance into a large hole is less than the flow resistance for a small hole. A very small quantity of sealant liquid is used and thus the cost per linear foot has been as low as 0.1 cent.

Certain materials will tend to heat the needles, such as vinyl fabric. Using the method and apparatus of the present invention, such heating has been reduced. It is believed that the liquid lubricates the needle, thus minimizing temperature rise and avoiding any need for needle cooling means.

Other configurations and locations for the discharge end 42 as well as other liquids to be injected enhance the usefulness of the present invention.

If it be desired to have a second seal 44 within the lapped portion of the sheet of material 21, then, as understood from FIG. 7, a second tube 28 may be added so that its discharge end is directly above the one illustrated, and secured to the S-shaped guide 19 within the lower curve of the S, and thus just above and adjacent to the edge 22 of the sheet 21. While one seal 44 is normally sufficient, the second seal may be provided to have some different property. If a three-needle machine is utilized, then a second tube 28 may be disposed in parallel to the one illustrated and also secured to the lower side of the S-shape in slightly spaced relation so that the space between the two tubes would be aligned with the center needle. This arrangement is also advantageous for a single or double needle machine where a second liquid is desired in the lap of the seam. Further, a second tube 28 may be provided concentric with the illustrated tube 28 to enable blending of two liquids as they discharge from the discharge ends of the tubes. Normally, the discharge end 42 is round in cross section, but the same may be flattened slightly to minimize the thickness thereof between the laps of material. One advantage to the location of the seal 44 as shown in FIG. 2 is that the edge of it is visible to the operator which is of importance in regulating the flow rate of the liquid in the first instance.

Although a viscous sealant is an especially useful liquid, other liquids may be employed to be able to provide other properties or functions. For instance, a liquid with an adhesive property applied to the thread can prevent unraveling of a seam made on a bobbinless sewing machine. This is the kind of seam that ordinarily if you pull on one end of the thread, the entire seam unravels. With an adhesive, in such seam, unraveling is prevented. Further, a liquid may be used to provide marking or identification if there is a contrasting color. Also, an additive to a liquid or a liquid may be provided for preventing mold or mildew. A liquid may be selected in order to provide a desired chemical reaction such as dye coloring. A liquid may be selected to provide matching or contrasting color. The method and apparatus may be used to inject a heat or light activated liquid into the seam for subsequent treatment. A liquid or an additive may be utilized to provide an insecticide property. With all these potential uses, it is clear that the method and apparatus can be utilized to provide a specialized sewn seam.

No matter what the type of seam desired is, assuming that a folder is used, each tube 28 is wound around the surfaces and surface edges of the folder in a serpentine fashion to have the discharge end at or just beyond the end of the folder, with the tube so disposed that it will not interfere with movement of the fabric through the folder.

The sealant or other liquid is also applied to other parts of the thread illustrated in FIG. 2 that extend beyond the seal 44. During bobbin type of sewing, the thread is picked up from the tip of the needle after the needle has fully penetrated the seam, and an excess loop is passed physically around the bobbin which floats in a mechanical chamber of the sewing machine. After looping around the bobbin and the bobbin thread, the excess needle thread is drawn back up through the needle eye until tight, which is the process for making a stitch. This long section of thread is thus pulled through the hole in the fabric and the liquid two times for each stitch. To prevent build up of liquid on the needle, the liquid should be relatively thick and may even be thixotropic so that the high speed moving thread will not be wetted at first. But when the stitch has been made, the hydrostatic pressure is adequate to shear thin the fluid enough to fill the needle holes, the seam lap, and slowly wet the stationary thread in the holes and the short thread sections spanning the needle holes.

As there normally is a film of oil on all parts of the sewing machine, and as a water-based liquid is used, the sealant or other liquid will not adhere to these parts, even after the liquid has dried. Any excess liquid that inadvertently gets on the outer surface of the sewing machine will not run and spread to other parts of the machine and it will not leak into the crevices of the machine. Also, any excess thick fluid does not spread on the surface of the sewn fabric, but remains in the localized area of the seam where it quickly dries without much cause of contamination to other sections of the sewn article.

Generally speaking, the smallest possible fluid lines, return lines or tubes should be used to minimize the volume of liquid contained therein. As there is a tendency for liquids to have air or vapor voids, there is a tendency for the liquid to be compressively resilient, and this tendency is minimized by minimizing the liquid volume under pressure.

Where the liquid contains a latex suspension, it is preferable that surfaces contacted by such liquid be of stainless steel or plastic as these materials minimize the possibility of latex conglomeration. In use, no contamination of the needles or breakage of the thread occurs. If there is an excess amount of sealant on the needle, it is believed that the last layer of fabric being penetrated would serve as a wiper for any such excess.

A cap or plug (not shown) may be provided on the discharge end 42 of the tube 28 when the device is not in use.

When the device is to be placed into use, the air in the lines needs to be bled out by the liquid. However, if any air or vapor pocket should form in the line and pass through the tube 28, the result will be harmless because the presser foot 22 and the roller 32 squeegees the liquid to fill any such void. If any air or vapor pocket passes into the return line 29, then when it reaches the reservoir 26, it becomes vented to atmospheric pressure.

Although various minor modifications might be suggested by those versed in the art, it should be understood that I wish to embody within the scope of the patent warranted hereon, all such embodiments as reasonably and properly come within the scope of my contributions to the art.

I claim as my invention:

1. Apparatus for a sewing machine having a needle reciprocable through a pressure foot, comprising:

(a) a pump adapted to be connected to a supply of viscous liquid;

(b) a fluid line leading from the outlet of said pump; and (c) a tube connected to said fluid line, said tube being adapted to be supported by the sewing machine and having a discharge end disposed adjacent to but ahead of said pressure foot, said tube being so curved that layers of material to be sewn together can respectively freely pass above and below said discharge end to enable the feed of the lapped material to the pressure foot and needle.

2. Apparatus according to claim 1, said pump being adapted to be driven by said sewing machine and being of the constant displacement type, whereby the rate of pumping will be directly controlled by the speed of the sewing machine.

3. Apparatus according to claim 1, including a foot-operated valve in said fluid line.

4. Apparatus according to claim 2 including a spring biasing said lever to normally close said second collapsible portion.

5. Apparatus according to claim 1 including a pressure roller adapted to be secured to the sewing machine for continuously flattening the seam as it emerges from the pressure foot before liquid in the seam has dried.

6. Apparatus according to claim 1 wherein the sewing machine has a plurality of needles for forming a plurality of seams, one said discharge end being disposed between each prospective pair of adjacent seams.

7. Apparatus for a sewing machine having a needle reciprocable through a pressure foot, comprising:

(a) a pump adapted to be connected to a supply of viscous liquid;

(b) a fluid line leading from the outlet of said pump;

(c) a tube connected to said fluid line, said tube being adapted to be supported by the sewing machine and having a discharge end disposed adjacent to said pressure foot, said tube being so curved that layers of material to be sewn together can respectively freely pass above and below said discharge end to enable the feed of the lapped material to the pressure foot and needle;

(d) a return line connected to said fluid line and adapted to conduct liquid therefrom to the supply of liquid; and (e) valve means for directing fluid from said fluid line selectably to one of said tube and said return line, said valve means comprising (1) a first collapsible portion in said return line, (2) a second collapsible portion in said fluid line downstream of its connection with said return line, (3) a pivoted lever disposed to alternatively collapse one of said collapsible portions, and (4) a foot-operated control connected to said lever for selecting its position.

8. Apparatus according to claim 1, including a return line directly interconnecting said fluid line to the supply of liquid, and a pedal-operated control having a first valve portion connecting said fluid line to said tube and a second valve portion in said return line, said valve portions being alternatively closeable whereby liquid is selectably directed.

* * * * *